US012270187B2

(12) United States Patent
Wang

(10) Patent No.: US 12,270,187 B2
(45) Date of Patent: Apr. 8, 2025

(54) SINK SPLASH GUARD

(71) Applicant: Feilong Wang, Montreal (CA)

(72) Inventor: Feilong Wang, Montreal (CA)

( * ) Notice: Subject to any disclaimer, the term of this patent is extended or adjusted under 35 U.S.C. 154(b) by 225 days.

(21) Appl. No.: 17/971,973

(22) Filed: Oct. 24, 2022

(65) Prior Publication Data

US 2024/0133167 A1 Apr. 25, 2024
US 2024/0229434 A9 Jul. 11, 2024

(51) Int. Cl.
*E03C 1/181* (2019.01)

(52) U.S. Cl.
CPC ..... *E03C 1/181* (2013.01)

(58) Field of Classification Search
CPC ..... E03C 1/181; E03C 1/186; A47J 47/20; A47K 3/302; A47K 2003/305
See application file for complete search history.

(56) References Cited

U.S. PATENT DOCUMENTS

| | | | | |
|---|---|---|---|---|
| 1,408,812 | A | 3/1922 | Leighton | |
| 1,709,545 | A | 4/1929 | Sheppard | |
| 1,817,330 | A * | 8/1931 | Wilson, Jr. | E03C 1/186 D23/290 |
| 2,692,991 | A | 11/1954 | Church | |
| D325,249 | S | 4/1992 | Kliebert | |
| 6,253,395 | B1 | 7/2001 | Quam | |
| 6,564,398 | B1 | 5/2003 | Trott | |
| D725,246 | S | 3/2015 | DiPirro | |
| 9,226,621 | B1 | 1/2016 | Jones et al. | |
| 9,260,845 | B1 | 2/2016 | Siegel | |
| 2014/0373269 | A1 | 12/2014 | Murray | |
| 2017/0014003 | A1 | 1/2017 | Byun | |
| 2019/0387929 | A1 | 12/2019 | Furler | |

FOREIGN PATENT DOCUMENTS

| | | | |
|---|---|---|---|
| KR | 930002930 | * | 5/1993 |
| KR | 20140021851 A | * | 2/2014 |
| WO | WO-2020067586 A1 | * | 4/2020 |

OTHER PUBLICATIONS

Feilong Wang, Tyoaro Silicone Sink Splash Guard—Water Splash Guard for Kitchen, Bathroom & Island Sinks—Suction Cup Base—Premium Kitchen Sink Accessories (17.4L×1.8W×3.6H inches)—Gray, [Accessed May 21, 2022] https://www.amazon.com/TYOARO-Silicone-Sink-Splash-Guard/dp/B0928296LP.

(Continued)

*Primary Examiner* — Erin Deery
(74) *Attorney, Agent, or Firm* — Brett A. Schenck

(57) ABSTRACT

An approach is disclosed for preventing splashing of a liquid under a splashing area from a liquid source utilizing a barrier. The barrier includes a base, a top side of the base, a bottom side of the base, a first side of the base, a second side of the base, suction cups integrated into the bottom side of the base, a first angled foot is attached to the first side of the base, and a second angled foot is attached to the second side of the base. The first angled foot and the second angled foot are designed angled to allow a limited compression of the suction cups. When the barrier is placed on the splashing are, the suction cups are compressed to adhere to the area to form a seepage guard by the first angled foot preventing the liquid from seeping under the first angled foot.

20 Claims, 5 Drawing Sheets

(56) References Cited

OTHER PUBLICATIONS

Ginchain, "Barrier Water Strip Dam, Stay Dry Retainer for Wet and Dry Separation for Kitchen Sink Countertop Sink Cooktop Bathroom Tub," https://www.amazon.com/dp/B09MLDH4C3/.

Duzzy, "Duzzy 59 Inch Corner Water Strip Dam, Water-Blocking Self-Adhesive Baffle for Suitable for The Gap Between the Shower Kitchen Countertop Sink and Cooktop," https://www.amazon.com/dp/B085DMWVBF?th=1.

"Sink splash guard—silicone water guard for kitchen sink basin croco splash guard XL size—strong suction—splatter guard kitchen gadget Eco friendly durable for Kitchen, bathroom 19.6 L," https://www.amazon.com/dp/B08B397SYS.

"Sink Splash Guard (Navy Blue)—For Kitchen or Bathroom—100% Food Grade Silicone," https://www.amazon.com/dp/B09DK54PKD.

"59 Inch Bathroom Water Dam, Shower Door Threshold, Collapsiable Silicone Water Stopper,Kitchen Sink Splash Guard for Bathtub, Restroom," https://www.amazon.com/Bathroom-Threshold-Collapsiable-Silicone-Restroom/dp/B09DL59CFB/?th=1.

"Collapsible Shower Threshold Water Dam Buthtub Water Stopper Shower Barrier Rubber Dam Silicon Water Blocker Dry and Wet Separation for Bathroom," https://www.amazon.com/dp/B09TRCMT8B/?th=1.

"Sink Splash Guard—Silicone Water Splash Guard for Sink, Strong Suction Sink Splash Guard Behind Faucet, Kitchen sland Sink Backsplash Guard (17.3×4.1 Inch)—Grey," https://www.amazon.com/Sink-Splash-Guard-Silicone-Backsplash/dp/B09QX3J73V/.

"Lyumo Kitchen Sink Anti-Splash Guard Washing Dishes Vegetables Prevent Water Splash Board, Sink Water Guard, Anti-Splash Guard Board," https://www.walmart.com/ip/LYUMO-Kitchen-Sink-Anti-Splash-Guard-Washing-Dishes-Vegetables-Prevent-Water-Splash-Board-Sink-Water-Guard-Anti-Splash-Guard-Board/224880608.

"Grace Period Disclosure", Feilong Wang, Product: Tyoaro Silicone Sink Splash Guard, Title (183/200): Tyoaro Silicone Sink Splash Guard, Gray (17.4×1.7×3.6")—Water Faucet Guard for Kitchen, Island and Bathroom—Easy to Install, Secure Non-Slip Suction Cup Base—Dishwasher Safe (Tyoaro Silicone Sink Splash Guard, Gray (17.4×1.7×3.6")—Water Faucet Guard for Kitchen, Bathroom and Island—Suction Cup Base, Easy to Install—Dishwasher Safe ), Submitted to Amazon.com on Aug. 28, 2022.

"Grace Period Disclosure", Feilong Wang, Product: Tyoaro Silicone Sink Splash Guard, https://www.amazon.com/TYOARO-Silicone-Sink-Splash-Guard/dp/B0928296LP/ref=sr_1_6?crid=2Q81UFP45WIOZ&keywords=sink+splash+guard+behind+faucet&qid=1665980452&qu=eyJxc2MiOil3LjUyliwicXNhljoiNy4zNylsInFzcCl6ljYuOTMifQ%3D%3D&sprefix=sink+splash+guard+behind+faucet%2Caps%2C97&sr=8-6 , Available for purchase from Amazon.com on Aug. 28, 2022.

* cited by examiner

SINK SPLASH GUARD

STATEMENT REGARDING PRIOR DISCLOSURES BY THE INVENTOR OR A JOINT INVENTOR

The following disclosures are submitted under 35 U.S.C. 102(b)(1)(A):

DISCLOSURE: Feilong Wang, offer to sell on Amazon-.com, entered Aug. 28, 2022.

DISCLOSURE: Feilong Wang, product description on Amazon.com, Aug. 28, 2022.

BACKGROUND

The present invention relates to the field of protection devices, specifically to an approach to prevent splashing of liquid from a liquid source, usually water from a sink.

SUMMARY

According to one embodiment of the invention, there is provided a method for preventing splashing of a liquid under a splashing area from a liquid source utilizing a barrier. The barrier is positioned between the splashing area and the liquid source where the barrier includes a base, a top side of the base, a bottom side of the base, a first side of the base, a second side of the base, one or more suction cups integrated into the bottom side of the base, a first angled foot is attached to the first side of the base, and a second angled foot is attached to the second side of the base. The first angled foot and the second angled foot are designed angled to allow a limited compression of the one or more suction cups. The one or more suction cups are compressed to adhere to the area to form a seepage guard by the first angled foot. The seepage guard prevents the liquid from seeping under the first angled foot.

According to one embodiment of the invention, there is provided an apparatus for preventing splashing of a liquid under a splashing area from a liquid source. The apparatus includes a base, a top side of the base, a bottom side of the base, a first side of the base, a second side of the base, one or more suction cups integrated into the bottom side of the base, a first angled foot is attached to the first side of the base, and a second angled foot is attached to the second side of the base. The first angled foot and the second angled foot are designed angled to allow a limited compression of the one or more suction cups. The one or more suction cups are compressed to adhere to the area to form a seepage guard by the first angled foot when the apparatus is placed on the splashing area. The seepage guard prevents the liquid from seeping under the first angled foot.

According to one embodiment of the invention, there is provided a product for preventing splashing of a liquid under a splashing area from a liquid source. The product includes a base, a top side of the base, a bottom side of the base, a first side of the base, a second side of the base, one or more suction cups integrated into the bottom side of the base, a first angled foot is attached to the first side of the base, and a second angled foot is attached to the second side of the base. The first angled foot and the second angled foot are designed angled to allow a limited compression of the one or more suction cups. The one or more suction cups are compressed to adhere to the splashing area to form a seepage guard by the first angled foot when the product is placed on the splashing area. The seepage guard prevents the liquid from seeping under the first angled foot.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention will be apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings, wherein.

DETAILED DESCRIPTION

Currently, there are existing products that are intended to provide protection from splashing in environments such as, kitchen sinks, kitchen island, bathroom sinks, utility room and other environments used to work with liquids, for example, cleaning artifacts, such as, dishes. There is literature on a variety of a splash guards for sinks (and for related fixed basins with a water supply and a drain). Many of these guards are removably secured to a region near the sink, by suction cups or by other means.

However, none of the existing products appear to prevent the liquid, e.g., water from reaching the user behind the product. Some of the products have suction cups supporting affixing the product to a surface, but the existing products allow the liquid to seep under the bottom of the product.

Given the deficiency of the prior art, a method, apparatus, and product are disclosed that prevents the liquid, e.g., water from reaching the user behind the product. In an embodiment, the disclosed barrier, referred herein as "splash guard" may be secured and positioned between a user and a flowing liquid source. The disclosed splash guard may be repositioning or removed as needed. The liquid source may be, for example, but not limited to kitchen sinks, kitchen island, bathroom sinks, utility room, a hose, and the like. The liquid may be used, for example, but not limited to, cleaning, such as dishes, diluting, mixing, and the like.

Figure 1:
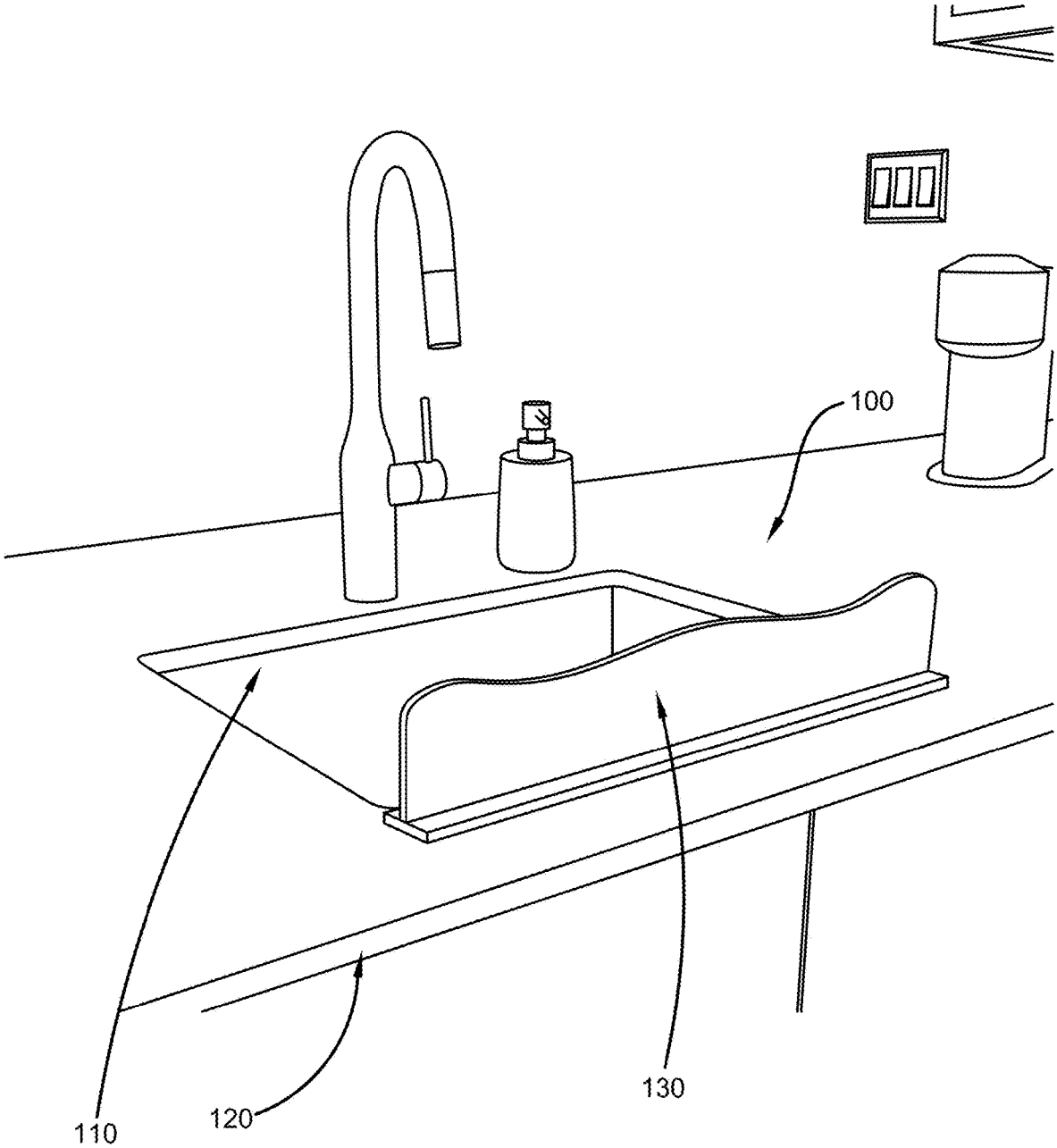
FIG. 1 depicts a front view of a splash guard placed on a surface.

FIG. 1 depicts a front view of a splash guard placed on sink countertop 100. The splash guard becomes a barrier preventing seepage of water under the barrier. A typical sink 110 is shown. The sink 110 as shown may be, for example, but not limited to a kitchen sink, a bathroom sink, a utility room sink, and the like. The splash guard is depicted in an embodiment, where the splash guard is placed on the front of a countertop 120. In the depicted embodiment, the splash guard is shown in an upright view from a first side, which may be referred to as a front side or a user side 130. In this example usage, the splash guard is placed on the front of the countertop 120 containing the sink. In some embodiments, the splash guard my fit on the sink itself. In this view the angled feet are compressed against the countertop.

Figure 2:
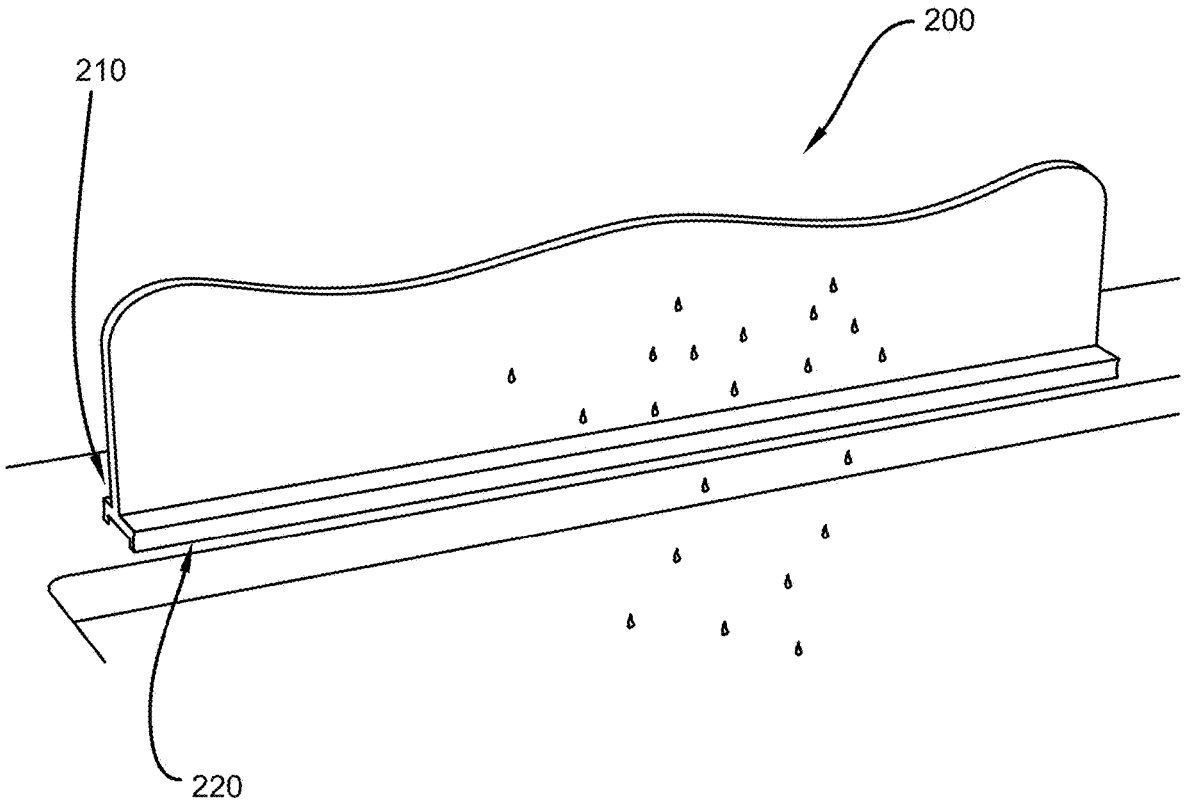
FIG. 2 depicts a rear view of a splash guard placed on a surface.

FIG. 2 depicts a rear view of a splash guard placed on a sink 200. 210 points to the angled foot on a first side, which may be referred to as a front side or a user side of a splash guard shown from the top side of the base. 220 points to the angled foot shown on a second side, which may be referred to as a back side, a rear view, or a sink side of a splash guard behind the sink showing a top side of the base. In this view the angled feet are compressed against the countertop.

Figure 3:
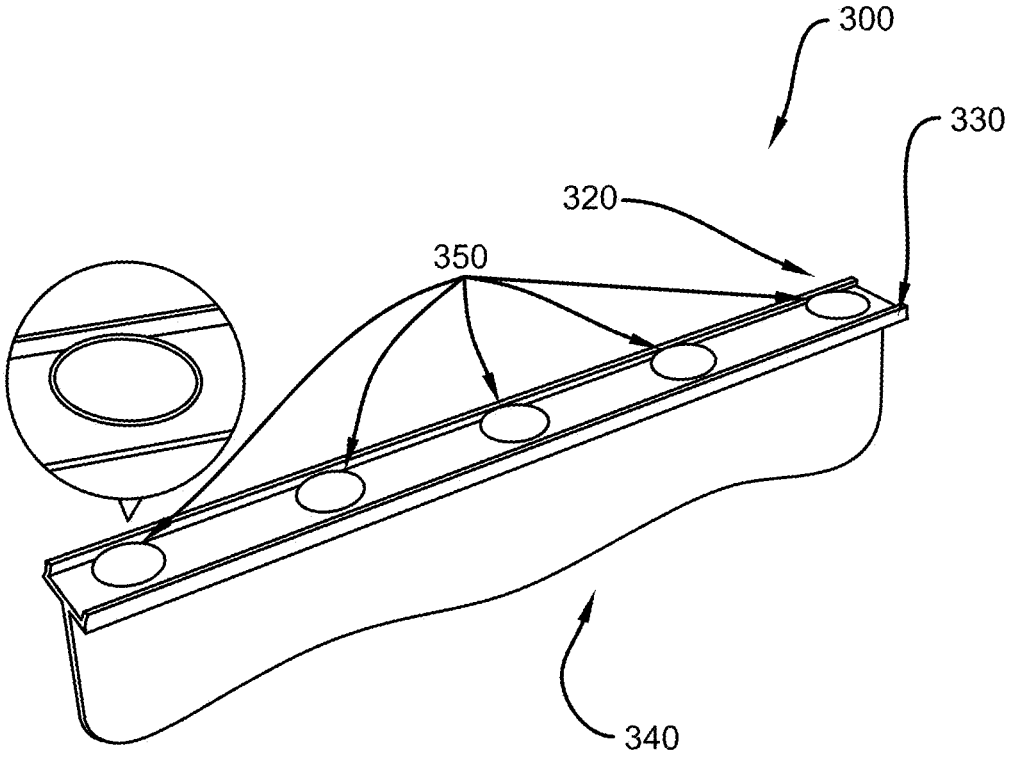
FIG. 3 depicts upside down view of a splash guard.

FIG. 3 depicts an embodiment with an upside-down view of a splash guard 300. 340 depicts a full upside down and bottom view of a splash guard in an embodiment depicted with five suction cups 350. 310 points to a first side, a front side, or a user side angled foot. 320 points to a second side, a rear side, or a sink side angled foot.

Figure 4:
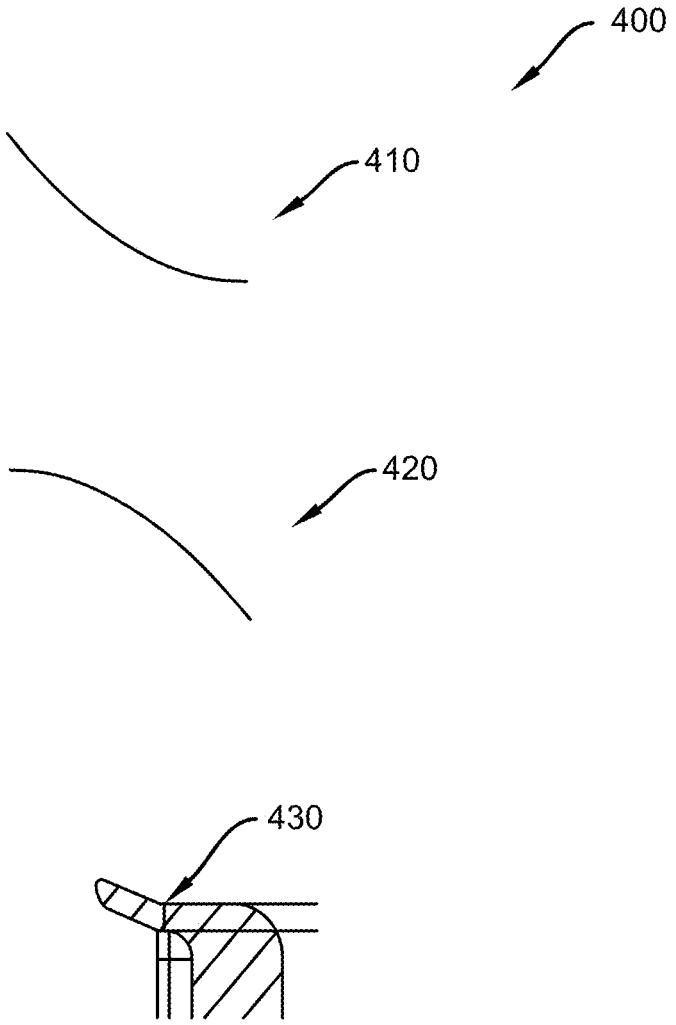
FIG. 4 depicts example angled foot variations.

FIG. 4 depicts example angled foot variations or characteristics 400. 410 depicts an example of concave up. 420 depicts an example of concave down. 430 depicts an example where the angled foot has a virtual hinge or pivot point. In an embodiment, the sink splash guard is positioned between the user and the sink with a first angled foot that is concave up and facing the sink with the foot attached to a vertical side wall that is integrated into suction cup assemblies that attaches outside of the sink. Mathematically, a function is concave up if it "opens" up and the function is concave down if it "opens" down. Concavity has nothing to do with increasing or decreasing. A function can be concave up and either increasing or decreasing. Similarly, a function can be concave down and either increasing or decreasing. More formally, for a given the function f(x)f(x) then:

1. f(x)f(x) is concave up on an interval II if all of the tangents to the curve on II are below the graph of f(x)f(x).
2. f(x)f(x) is concave down on an interval II if all of the tangents to the curve on II are above the graph of f(x)f(x).

The usage of a "concave up" geometry helps to redirect water away from the barrier, and the shape encourages flow down the vertical wall and finally away from the barrier.

In an embodiment, the angled feet are flexible and there is a hinging action (around a virtual pivot region of the material) in which the angled foot springs slightly upward (e.g. for example, by a fraction of a millimeter) to help create a better seal.

The gap, prior to compression, is from the fully extended suction cup to the fully extended angular feet. When a user presses on the splash guard, the angular feet bend at the virtual pivot region causing a compression of the suction cups, which eliminates the gap, facilitates the sticking of the suction cups to the surface, and the angular feet to be better positioned to prevent liquid from seeping under the angled feet.

In an embodiment, the angled feet may be made of a different material than the side wall. It may have different characteristics, for example, but not limited to texture, modulus of elasticity, rigidity, stiffness, stickiness, springiness, tensile strength, hydrophobicity, frictional interactions, durability, resilience, and the like. It may be replaceable, allowing a user to purchase separately the angled foot and replace one of them if warn out or damaged.

Figure 5:
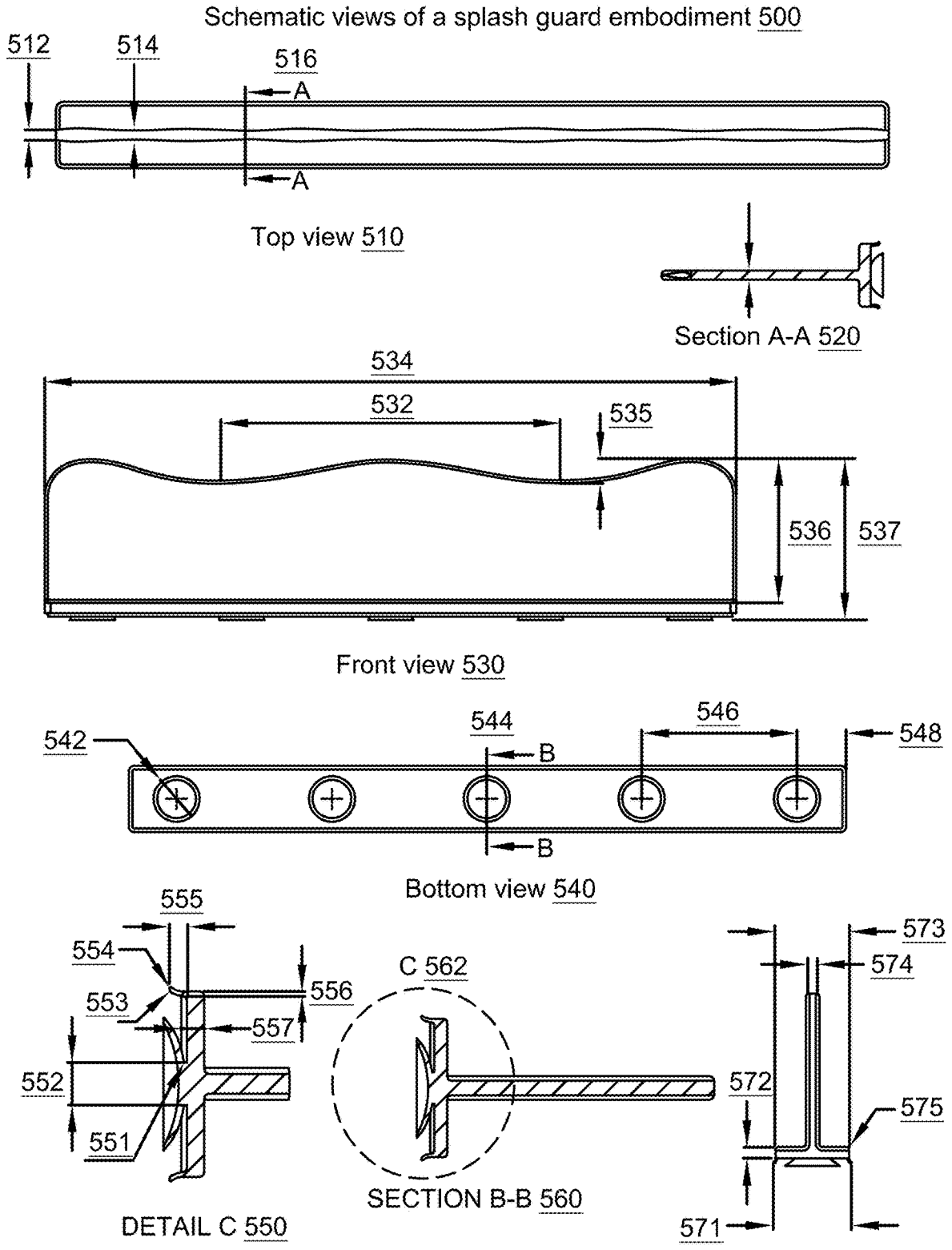
FIG. 5 depicts an example schematic view of a splash guard.

An embodiment of the splash guard is depicted in FIG. 5. In the embodiment, the splash guard is a single manufactured part without any replaceable subparts. In the embodiment, the splash guard is constructed with Bisphenol-A free (BPA-free). food-grade silicone which is heat, stain and odor-resistant. In the embodiment, a wave design improves usability in supporting movement, while the unique angled foot ensures water won't seep under the bottom. In an embodiment, a non-slip grip is supported by a base of 5 integrated silicone suction cups which remains firmly in place, even when wet. From marble and granite to laminate and wood, it's easy to install on any smooth surface with no tools required. In the embodiment, the disclosed multipurpose design using less than 2" of counter space and may be position and moved as needed, such as, but not limited to being in front of, behind or next to the sink, making it as versatile as it is effective. In the embodiment, the splash guard measures 17.4" long, 1.7" wide and 3.6" high. Other sizes may be provided, and a combination of multiple guards may be used to accommodate larger sinks or irregular environments. In the embodiment, the sink splash guard may be cleaned by rinsing with warm, soapy water or running through a dishwasher. Made with BPA-free food-grade silicone, its heat, stain and odor-resistant.

FIG. 5 depicts schematic views of a splash guard embodiment 500. 510 depicts a top view of a splash guard. In this depiction the numbers are in millimeters (mm), nX, represents n number of occurrences, Rx indicates a radius of x mm, and Dx indicates a diameter of x mm. 512 depicts the greatest width of the wave design with a value of 6.60 mm repeated 8 times. 514 depicts the minimum with of the wave design with a value of 4.20 mm repeated 5 times. 516 depicts a top view where the width is at a minimum and over a suction cup as shown in section A-A 520. 530 depicts a front view of a splash guard. 532 depicts the width of 216.29 mm from the wave design between two wave design valleys where the valley has the smallest height splash guard. 534 depicts the 440 mm full width of the splash guard. 535 depicts the 13.23 mm difference between the peak, which has the greatest height of the splash guard and the valley of the splash guard that occurs twice. 536 depicts the 82.15 mm height of the splash guard from the peak to the top of the base which occurs 3 times. 537 depicts the height of the splash guard from the peak to the bottom most point of the angled foot, 540 depicts a bottom view. 542 depicts the diameter of 29.00 mm of a suction cup for each suction cup, for a total of 5 times. 544 depicts a cross section of the bottom view section B-B containing a suction cup embedded between the angled feet. 546 shows the distance 95 mm between two suction cups repeated 4 times. 548 depicts the distance 30.00 mm between the center of an end suction cup and the end of the base. 560 depicts details of SECTION B-B with the circled portion C 562 shown in detail C 550. 551 depicts a radius (R) of 0.30 mm of the circular bottom of the suction cup. 552 depicts the width 9.00 mm of a suction cup at the base. 553 depicts the radius 1.00 mm for the interior portion of the angled foot, which is for each angled foot in this diagram. 554 depicts the radius 0.20 mm for the exterior portion of the angled foot, which is for each angled foot in this diagram. 555 depicts the 4.25 mm length of the angled foot from the bottom of the base to the top of the angled foot for each angled foot in this diagram. 556 depicts the 1.00 mm width of the angled foot at the base. 557 depicts the 4.00 mm width of the base. 570 depicts a sectional view of a side view of the splash guard. 571 depicts the total 41.83 mm width between the outer most end points of the angled feet. 572 depicts the 5.50 mm width of the base. 573 depicts the 40.00 mm width of the base. 574 depicts the 6.60 mm maximum width of the wave design portion of the splash guard. 575 depicts the 1.20 mm radius of each of the 4 a round corner of the base of the splash guard.

While particular embodiments have been shown and described, it will be obvious to those skilled in the art that, based upon the teachings herein, that changes, and modifications may be made without departing from this invention and its broader aspects. Therefore, the appended claims are to encompass within their scope all such changes and modifications as are within the true spirit and scope of this invention. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

What is claimed is:

1. A method for preventing splashing of a liquid under a splashing area from a liquid source utilizing a barrier comprising:

positioning the barrier between the splashing area and the liquid source wherein the barrier includes a base, a top side of the base, a bottom side of the base, a first side of the base, a second side of the base, a plurality of suction cups integrated into the bottom side of the base, a first angled foot is attached to the first side of the base, a second angled foot is attached to the second side of the base, and wherein the first angled foot and the second angled foot are designed angled to allow a limited compression of the suction cups, wherein the first side comprises a first vertical side wall, wherein the first angled foot is attached to the first vertical side wall, wherein the first vertical wall is attached to and depends downwardly from the top side of the base, wherein the first angled foot comprises a first pivot point, wherein the first angled foot and the first pivot point are configured to enable the first angle foot to bend at the first pivot point and spring upward to help in preventing the liquid from seeping under the first angled foot;

compressing the plurality of suction cups to adhere to the splashing area; and forming a seepage guard by the first angled foot preventing the liquid from seeping under the first angled foot.

2. The method of claim 1, wherein the top side lies in a horizontal plane.

3. The method of claim 1, wherein the first angled foot is integrated into the first side of the base.

4. The method of claim 3, wherein the first angled foot is concave up.

5. The method of claim 4, wherein compressing the plurality of suction cups further comprises: compressing automatically when the barrier is placed on the area.

6. The method of claim 5, wherein the first angled foot compression is less than one millimeter when the barrier is placed on the area.

7. The method of claim 6, wherein the first angled foot and the plurality of suction cups form a stronger bond with the area responsive to a pressure applied to the barrier compared to the compressing automatically due to a weight of the barrier and gravity.

8. The method of claim 3, wherein the second angled foot is integrated into a second side of the base.

9. The method of claim 8, wherein the second angled foot is concave up.

10. The method of claim 1, wherein the first angled foot is made from a first material and the base is made from a second material and wherein the first material is different from the second material.

11. The method of claim 1, wherein the first angled foot is replaceable.

12. An apparatus for preventing splashing of a liquid under a splashing area from a liquid source wherein the apparatus includes a base, a top side of the base, a bottom side of the base, a first side of the base, a second side of the base, a plurality of suction cups integrated into the bottom side of the base, a first angled foot is attached to the first side of the base, and a second angled foot is attached to the second side of the base and wherein the first angled foot and the second angled foot are designed angled to allow a limited compression of the suction cups and wherein the plurality of suction cups are configured to compress to adhere to the splashing area and form a seepage guard by the first angled foot preventing the liquid from seeping under the first angled foot, wherein the first side comprises a first vertical side wall, wherein the first angled foot is attached to the first vertical side wall, wherein the first vertical wall is attached to and depends downwardly from the top side of the base, wherein the first angled foot comprises a first pivot point, wherein the first angled foot and the first pivot point are configured to enable the first angle foot to bend at the first pivot point and spring upward to help in preventing the liquid from seeping under the first angled foot.

13. The apparatus of claim 12, wherein the top side lies in a horizontal plane.

14. The apparatus of claim 12, wherein the first angled foot is integrated into the first side of the base.

15. The apparatus of claim 14, wherein the first angled foot is concave up.

16. A product for preventing splashing of a liquid under a splashing area from a liquid source wherein the apparatus includes a base, a top side of the base, a bottom side of the base, a first side of the base, a second side of the base, a plurality of suction cups integrated into the bottom side of the base, a first angled foot is attached to the first side of the base, and a second angled foot is attached to the second side of the base and wherein the first angled foot and the second angled foot are designed angled to allow a limited compression of the suction cups and wherein the plurality of suction cups are configured to compress to adhere to the splashing area and form a seepage guard by the first angled foot preventing the liquid from seeping under the first angled foot, wherein the first side comprises a first vertical side wall, wherein the first angled foot is attached to the first vertical side wall, wherein the first vertical wall is attached to and depends downwardly from the top side of the base, wherein the first angled foot comprises a first pivot point, wherein the first angled foot and the first pivot point are configured to enable the first angle foot to bend at the first pivot point and spring upward to help in preventing the liquid from seeping under the first angled foot.

17. The product of claim 16, wherein the top side lies in a horizontal plane.

18. The product of claim 16, wherein the first angled foot is integrated into the first side of the base.

19. The product of claim 18, wherein the first angled foot is concave up.

20. The product of claim 19, wherein the first angled foot compresses automatically when placed on the splashing area.

* * * * *